US009024164B1

(12) United States Patent
Keely

(10) Patent No.: US 9,024,164 B1
(45) Date of Patent: May 5, 2015

(54) ANCHORING DEVICE AND METHOD FOR RESTRAINING MOVEMENT OF A KICK DRUM

(71) Applicant: Wesley K. Keely, Wyoming, MI (US)

(72) Inventor: Wesley K. Keely, Wyoming, MI (US)

( * ) Notice: Subject to any disclaimer, the term of this patent is extended or adjusted under 35 U.S.C. 154(b) by 0 days.

(21) Appl. No.: 14/164,585

(22) Filed: Jan. 27, 2014

(51) Int. Cl.
*G10D 13/02* (2006.01)

(52) U.S. Cl.
CPC ..... *G10D 13/026* (2013.01)

(58) Field of Classification Search
None
See application file for complete search history.

(56) References Cited

U.S. PATENT DOCUMENTS

| | | | | | |
|---|---|---|---|---|---|
| 1,022,149 | A | * | 4/1912 | Maphet | 84/421 |
| 1,604,670 | A | * | 10/1926 | Willis et al. | 84/422.1 |
| 1,630,701 | A | * | 5/1927 | Gladstone | 84/421 |
| 2,503,135 | A | * | 4/1950 | Sikora | 84/421 |
| 2,902,794 | A | * | 9/1959 | Ehrgott | 248/188.9 |
| 2,919,618 | A | * | 1/1960 | Slingerland, Jr. | 84/421 |
| 2,944,366 | A | * | 7/1960 | Joabson | 248/346.11 |
| 3,704,645 | A | * | 12/1972 | Grauso et al. | 84/421 |
| 4,279,189 | A | * | 7/1981 | Kelly | 84/421 |
| 4,903,570 | A | * | 2/1990 | Sassmannshausen et al. | 84/421 |
| 5,743,506 | A | * | 4/1998 | Adams | 248/346.11 |
| 5,823,492 | A | * | 10/1998 | Anselmo | 248/188.1 |
| 5,988,574 | A | * | 11/1999 | Podgorski et al. | 248/188.4 |
| 6,031,170 | A | * | 2/2000 | Hoshino | 84/422.3 |
| 6,119,998 | A | * | 9/2000 | Anselmo | 248/346.11 |
| D432,904 | S | * | 10/2000 | Anselmo | D8/374 |
| 6,541,685 | B2 | * | 4/2003 | Meinl | 84/421 |
| 6,840,488 | B2 | * | 1/2005 | Ngo et al. | 248/346.11 |
| 7,834,259 | B2 | * | 11/2010 | Jeffries et al. | 84/421 |
| 8,084,676 | B2 | * | 12/2011 | Shigenaga | 84/421 |
| 8,203,064 | B2 | * | 6/2012 | Jeffries et al. | 84/421 |
| 2005/0109898 | A1 | * | 5/2005 | Hsieh | 248/188.9 |
| 2005/0241458 | A1 | * | 11/2005 | Liao | 84/421 |
| 2010/0107854 | A1 | * | 5/2010 | Dixson, Jr. | 84/421 |
| 2011/0133043 | A1 | * | 6/2011 | Chang | 248/188.9 |
| 2014/0026734 | A1 | * | 1/2014 | Sato et al. | 84/421 |

* cited by examiner

*Primary Examiner* — Robert W Horn
(74) *Attorney, Agent, or Firm* — John R. Benefiel

(57) ABSTRACT

An anchoring device and method for kick drums in which an elongated member is connected to each kick drum spur and each member has an engagement base piece pivotally mounted thereto, the engagement base piece having an array of pointed features projecting from an undersurface adapted to penetrate into a floor covering to resist any tendency of movement of the kick drum on a floor when being played.

7 Claims, 2 Drawing Sheets

ANCHORING DEVICE AND METHOD FOR RESTRAINING MOVEMENT OF A KICK DRUM

CROSS REFERENCE TO RELATED APPLICATIONS

This application claims the benefit of U.S. provisional patent application No. 61/578,480 filed on Jan. 30, 2013.

BACKGROUND OF THE INVENTION

This invention concerns "kick" drums which have a foot pedal which operates a beater used to strike the drum. The drum rests on its side in front of the drummer.

A common problem is the tendency for the drum to slowly move away from the drummer with continued play as a result of the beating action. Such drums are equipped with "spurs", i.e., elongated members adjustably mounted to the drum on each side, which have a rubber tip holding a spike which engages the floor covering in front of the drum. These spurs help position the drum and are intended to resist the tendency of the drum to inch away from the drummer with continued play.

However, the beater drum will rock slightly when played which will cause the drum to shift despite the presence of the spurs since this rocking motion lifts the spurs slightly and allows the drum forward movement.

Accordingly, additional measures have been devised to more completely overcome the tendency of a kick drum to shift position during playing. One such measure is a double spike fixture that clamps on the drum rim at its point of contact with the floor covering, the pair of spikes engaging the floor covering to provide added resistance to any shifting motion of the drum. Since such drums are often struck quite forcefully during playing, this measure has also not completely solved the problem as the rocking motion also tends to weaken the engagement of those spikes with the floor covering as well.

Another attempt at a solution for the problem has involved the use of a "gig rug", which is comprised of a piece of carpeting on which the drum is placed, with an attached board disposed in front of the drum, which engages rim so as to resist any shifting movement away from the player. The gig rug creates other problems, however, since it is a bulky separate item which always needs to be remembered and packed and unpacked when the drum is taken to a gig. Also, the attached board is often not noticed when in place and presents a tripping hazard to persons working around the drum set, such as sound set up people. Also, the board sometimes comes loose and is then easily lost.

It is an object of the present invention to provide a device which securely prevents shifting movement of a kick drum as it is played and also that remains assembled to the drum itself, and does not present a tripping hazard.

SUMMARY OF THE INVENTION

The above recited object and other objects of the present invention which will be understood by those skilled in the art upon reading the following specification and claims, are achieved by a replacing the spike on each of the spurs with an anchoring device which is mounted to the spur in a way that allows relative pivoting motion between the spur and a floor covering engagement piece included in each anchoring device.

The floor engagement piece comprises a flat base piece having an undersurface provided with an array of downwardly projecting pointed features which will very effectively engage a floor covering to completely resist any sliding movement of the drum away from a player.

The large number of point features greatly increases the resistance to any movement of the drum during playing, while the pivoting mounting of the base engagement piece minimizes the tendency for the base piece to tip and lift as the drum rocks, insuring that these pointed features will remain in secure engagement with the floor covering and thus continue to strongly resist any sliding movement of the drum as it is played.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
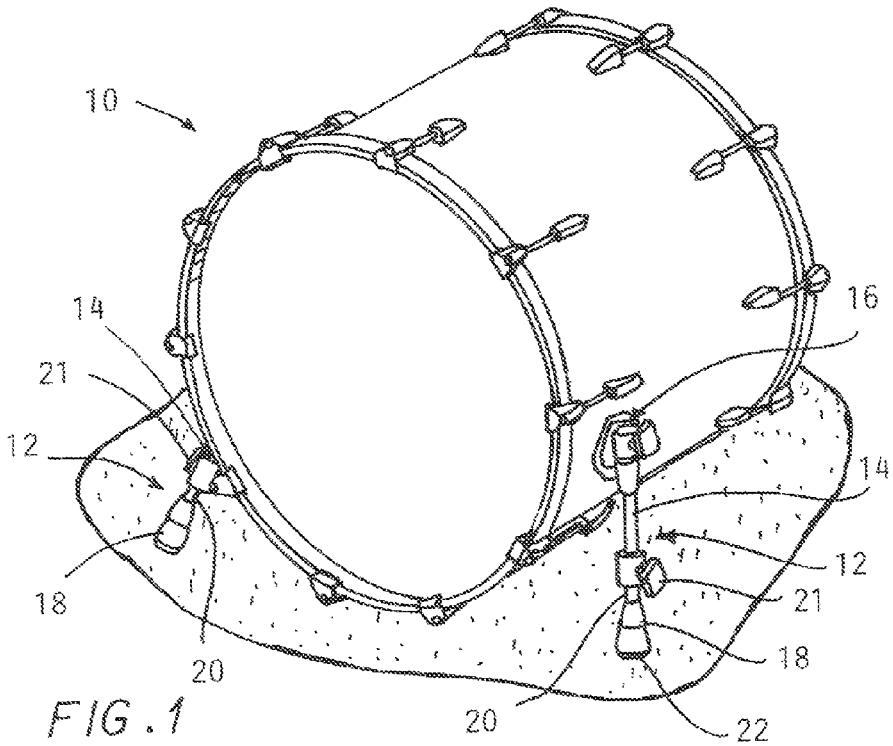
FIG. 1 PRIOR ART
FIG. 1 is a pictorial view of a kick drum having a pair of conventional elongated spurs mounted to the kick drum.

Referring to the drawings and particularly FIG. 1, a kick drum 10 is shown which is equipped with a pair of conventional elongated spurs 12 at the forward end of the drum 10 which is normally positioned on its side as shown when being played.

The spurs 12 each extend forwardly from the drum and laterally away from each other.

Each spur 12 includes an upper tube 14 attached to the perimeter of the drum 10 with a bracket 16. A floor covering engagement piece 18 is connected to a spur rod 20 which is telescoped into the upper tube 14 and able to be secured in any adjusted position by turning a knob 20 to loosen or tighten the connection therebetween.

The floor covering engagement piece 18 conventionally includes a spike (not shown) protruding from the bottom of a rubber cap 22 on the bottom of the engagement piece 18, which is attached to the rod 20.

Figure 2:
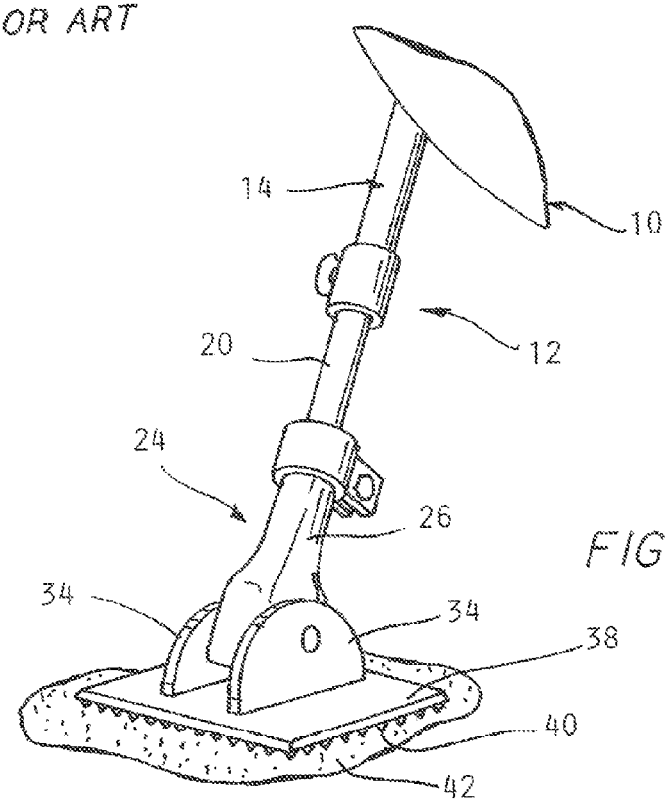
FIG. 2 is a pictorial enlarged view of one of the spurs of the kick drum shown in FIG. 1 which has mounted thereto an anchoring device according to the present invention.
Figure 3:
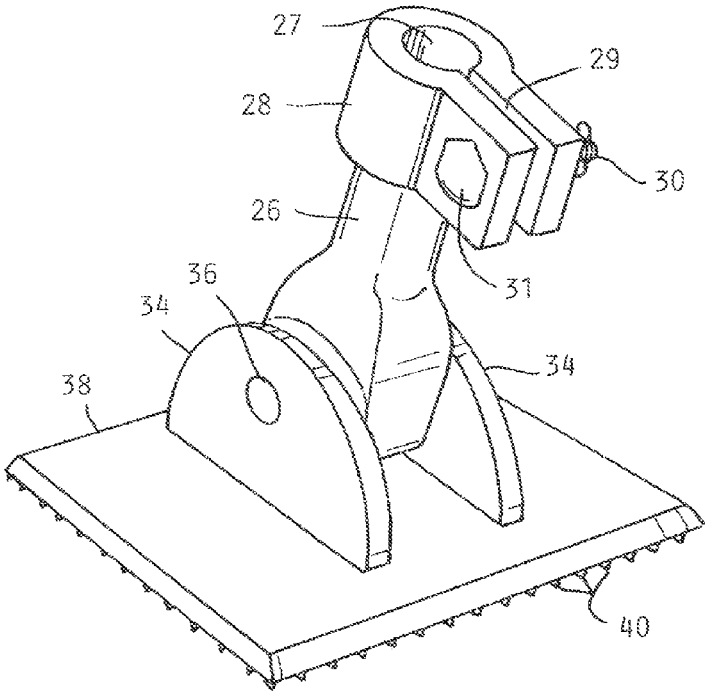
FIG. 3 is a further enlarged pictorial view of the anchoring device installed on the kick drum spur shown in FIG. 2.

FIG. 2 shows one of two anchoring devices 24 according to the present invention, which are each mounted to the rod 20 and upper tube 14 of a respective spur 12.

The anchoring devices 24 each include an elongated tubular socket 26 molded from a strong plastic such as nylon, and having an opening 27 sized to slidably receive one of the spur rods 20 after removal of the existing floor engagement piece 18.

A split sleeve collar 28 is molded into the top of socket 26, with a wing nut 30 threaded to a bolt 31 captured in the collar 28 enabling compression together of the sides of a slot 29 to securely grip the rod 20 in any adjusted position.

A squared lower end 32 of the socket 26 is pivotally mounted between two molded clevis arches 34, spaced apart to accommodate the socket lower end 32. A pin 36 passes through the clevis arches 34 and the squared lower end 32 creating a pivotal connection allowing the socket 26 to freely pivot with respect to a generally rectangular engagement base piece 38 to which the arches 34 are attached.

Figure 4:
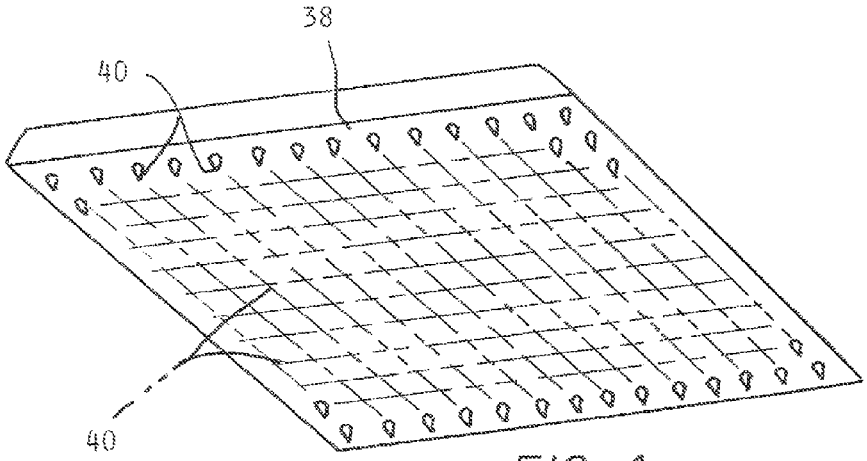
FIG. 4 is a pictorial view of the base piece shown in FIGS. 3 and 4 from below to show the array of pointed features projecting down from the bottom of an engagement base piece included in the anchoring device according to the invention.

The undersurface of the engagement base piece 38 is formed with a large number of downwardly projecting pointed features which may be arrayed in columns and rows as shown in FIG. 4. An array of 256 pointed features has been tried and found to very successfully function to securely engage a floor covering on which it rests and reliably resist any sliding motion of the drum 10 away from the player.

When the drum 10 rocks slightly during play, the pivotal connection avoids tipping up of the engagement base piece 38 which will in most instances instead remain in position flat against the floor covering 42 and thereby remain in engagement with the floor covering 42 rather than tilting up so as to lose its secure connection with the floor covering 42 as with some of the prior devices described above.

The anchoring devices 24, being relatively compact and always remaining attached to the spurs 14 do not present a tripping hazard to the same extent as the board of a gig rug as described above, such as to provide a better solution to the problems described.

Further, the anchoring devices 34 remain a part of the drum 10 and do not require separate handling, to avoid the inconvenience of making sure to remember a separate gig rug and to pack the same while providing a very secure stabilization of the position of the drum 10 on the floor in front of the player.

The invention claimed is:

1. An anchoring device for a kick drum having a pair of elongate rod member mounted thereto, each spur comprising an upper tube affixed to the drum and extending downwardly therefrom and a rod telescoped into said upper tube and securable therein in any selected adjusted position; said anchoring device including:

a socket having an opening configured to receive a lower end of said rod;

a clamp arrangement for securing said rod in said socket;

said socket pivotally mounted to an engagement base piece having an undersurface having an array of downwardly projecting pointed features formed thereon adapted to penetrate into a floor covering to resist against any tendency for shifting movement of said kick drum during as it is played.

2. The anchoring device according to claim 1 wherein said socket has a lower end received between two clevis features on said engagement base piece and pinned thereto to create said pivotal mounting.

3. The anchoring device according to claim 1 wherein said pointed features are arranged in rows and columns on said undersurface.

4. A method of anchoring a kick drum comprising an elongated member to said drum extending downwardly and forwardly therefrom, pivotally connecting each of said elongated members to a respective floor covering engagement base piece having an undersurface provided with downwardly pointing features adapted to engage a floor covering on which said kick drum rests to thereby resist shifting of the position of said kick drum on a supporting floor during playing of said kick drum.

5. The method according to claim 4 wherein each of said elongated members is provided with a socket opening configured to receive a rod in said upper tube of each kick drum spur and each rod is inserted into said socket opening of each respective elongated member and secured therein.

6. The method according to claim 4 including arranging said plurality of said pointed features in an array on an undersurface of said engagement base piece.

7. The method according to claim 6 including arranging said pointed features in columns and rows on said undersurface of said engagement base piece.

* * * * *